US007726223B2

(12) United States Patent
Kendall et al.

(10) Patent No.: US 7,726,223 B2
(45) Date of Patent: Jun. 1, 2010

(54) APPARATUS AND METHODS FOR ACCESSING PACKAGED MEDICAMENTS

(75) Inventors: Charles B. Kendall, Sussex, WI (US); David J. Van den Branden, Chicago, IL (US)

(73) Assignee: CB Products, Inc., Sussex, WI (US)

( * ) Notice: Subject to any disclaimer, the term of this patent is extended or adjusted under 35 U.S.C. 154(b) by 225 days.

(21) Appl. No.: 11/939,151

(22) Filed: Nov. 13, 2007

(65) Prior Publication Data

US 2008/0110917 A1 May 15, 2008

Related U.S. Application Data

(60) Provisional application No. 60/865,746, filed on Nov. 14, 2006, provisional application No. 60/912,150, filed on Apr. 16, 2007, provisional application No. 60/945,362, filed on Jun. 21, 2007, provisional application No. 60/972,183, filed on Sep. 13, 2007.

(51) Int. Cl.

| | |
|---|---|
| ***B26D 7/06*** | (2006.01) |
| ***B26D 7/02*** | (2006.01) |
| ***A21C 5/08*** | (2006.01) |
| ***A21C 15/04*** | (2006.01) |
| ***B26B 3/00*** | (2006.01) |
| ***B67B 7/00*** | (2006.01) |

(52) U.S. Cl. ..... 83/167; 83/465; 83/563; 83/946; 83/613; 30/315; 30/2; 30/280

(58) Field of Classification Search ..... 30/2, 30/113.1, 114, 120.1, 278, 280, 286, 294, 30/314, 315; 83/130, 162, 167, 30, 563, 83/613, 196–200, 465, 944, 946

See application file for complete search history.

(56) References Cited

U.S. PATENT DOCUMENTS

| | | | | | |
|---|---|---|---|---|---|
| 146,462 | A | * | 1/1874 | Kirkwood | 83/167 |
| 1,356,941 | A | * | 10/1920 | Rece | 30/242 |
| 1,597,646 | A | * | 8/1926 | Ziegler | 83/613 |
| 2,088,383 | A | * | 7/1937 | Miller | 83/404.3 |
| 2,108,972 | A | * | 2/1938 | Orner | 83/122 |
| 2,189,478 | A | * | 2/1940 | St George | 43/4 |
| 2,694,400 | A | * | 11/1954 | Brock, Jr. | 131/237 |
| 3,964,638 | A | | 6/1976 | Dimauro | |
| 4,909,414 | A | | 3/1990 | Heath | |
| 5,038,968 | A | | 8/1991 | Albetski | |
| 5,292,307 | A | | 3/1994 | Dolzine et al. | |
| 5,360,136 | A | | 11/1994 | Fyson et al. | |
| 5,368,187 | A | | 11/1994 | Poncetta et al. | |
| 5,442,892 | A | | 8/1995 | Burns, III et al. | |
| 5,449,265 | A | | 9/1995 | Legrady et al. | |
| 5,460,471 | A | | 10/1995 | Connor et al. | |
| 5,509,773 | A | | 4/1996 | Connor et al. | |
| 5,605,430 | A | | 2/1997 | Legrady | |
| 5,722,563 | A | | 3/1998 | Hunts | |
| 5,921,237 | A | | 7/1999 | Eisele et al. | |
| 5,971,951 | A | | 10/1999 | Ruskewicz | |
| 6,116,238 | A | | 9/2000 | Jackson et al. | |
| 6,540,101 | B1 | | 4/2003 | Kim | |
| 7,040,503 | B2 | | 5/2006 | Leichter et al. | |
| 7,104,417 | B2 | | 9/2006 | Hilliard | |
| 7,231,920 | B2 | | 6/2007 | Harvey et al. | |

* cited by examiner

*Primary Examiner*—Boyer D Ashley
*Assistant Examiner*—Bharat C Patel
(74) *Attorney, Agent, or Firm*—Arent Fox LLP; James J. Bindseil

(57) ABSTRACT

Apparatus and methods of accessing a packaged medicament include placing a blister-type package containing the medicament onto a receiving area of a holder with a blister portion of the package extending into an opening in the holder. The blister-type package is held in place while a severing device is moved relative to the opening to separate at least a part of the blister portion from the blister-type package in order to access the medicament.

14 Claims, 12 Drawing Sheets

APPARATUS AND METHODS FOR ACCESSING PACKAGED MEDICAMENTS

CROSS REFERENCE TO RELATED APPLICATIONS

The present Application for Patent claims priority to: Provisional Application No. 60/865,746, entitled "Apparatus And Method For Accessing Packaged Medicaments" filed Nov. 14, 2006; Provisional Application No. 60/912,150, entitled "Apparatus And Method For Accessing Packaged Medicaments" filed Apr. 16, 2007; Provisional Application No. 60/945,362, entitled "Apparatus for Accessing Packaged Medicaments" filed Jun. 21, 2007; and Provisional Application No. 60/972,183, entitled "Apparatus for Accessing Packaged Medicaments" filed Sep. 13, 2007. All of the above-listed Provisional Applications are hereby expressly incorporated by reference herein.

BACKGROUND

The described aspects relate to the opening of blister type medicaments especially by elderly or disabled persons.

Many over-the-counter and prescription medications are packaged in tamper-resistant blister packaging. Blister packaging normally requires the user to peel off a security liner, such as a plastic, metallic or paper coating, from the back of the package before the medication can be exposed or pushed through a foil inner liner. For elderly users in particular, removal of this security liner can be very difficult.

A simple apparatus and method of opening such a package is needed which does not require a high level of manual dexterity.

SUMMARY

The aspects described herein provide an apparatus and method of accessing a medicament in a blister-type package.

In an aspect, an apparatus for opening a blister-type package comprises a holder having a holder body comprising an internal surface defining an opening in the holder body. The holder further comprises a first receiving surface opposing a second receiving surface across the opening, wherein the opening is sized to receive a blister-portion of a blister-type package having a flange connected to the blister-portion, and wherein the receiving surface is configured to receive corresponding opposing portions of the flange. The apparatus further comprises a severing device connectable to the housing and relatively movable with respect to the opening into and out of a severing position. In the severing position, the severing device is operable to separate at least a part of the blister-portion from the blister-type package. Additionally, the apparatus comprises a securing component connectable to the holder and movable between a first open position and a second closed position. The securing component has a first securing surface connected to a second securing surface by a recessed surface, wherein the securing component in the second closed position is operable to generate a clamping force between the first securing surface and the first receiving surface and between the second securing surface and the second receiving surface and the recessed surface is spaced away from the holder.

In some aspects, a size of the recessed surface substantially corresponds to a size of the opening.

In some aspects, the opening comprises a first length and a first width both substantially in a first plane, and the recessed surface comprises a second length and a second width both substantially in a second plane, wherein the second length substantially corresponds to the first length and the second width substantially corresponds to the first width.

In some aspects, the apparatus further comprises a safety mechanism connectable with the securing component, wherein the safety mechanism comprises a blocking portion movable between a locked position and an unlocked position corresponding to the first open position and the second closed position, respectively. Further, in the locked position, the blocking portion is positioned to prevent the severing device from moving into the opening, and in the unlocked position the blocking portion is positioned to allow the severing device to move into the opening.

In some aspects, the apparatus further comprises a blister alignment component positionable relative to the opening to define a first opening size and a second opening size, wherein the second opening size is less than the first opening size.

In some aspects of the apparatus comprising the blister alignment component, a first portion of the internal surface of the holder defines at least a portion of the first opening size, and the blister alignment component comprises opposing alignment surfaces that define at least a portion of the second opening size. In such aspects, the first opening size is dimensioned to receive a first size blister-portion, and wherein the second opening size is dimensioned to receive a second size blister-portion smaller than the first size blister-portion. Additionally, in further such aspects, in a direction of the relative movement of the severing device and the holder, the opposing alignment surfaces are equally spaced from a centerline of the opening, wherein the centerline is substantially parallel to the direction of relative movement.

In some aspects, the apparatus further comprises a plunger movably connected to the holder, wherein the plunger comprises a plunger surface, and wherein the plunger is connected to the severing device. Additionally, the holder body comprises a first surface and a second surface defining a holder thickness, wherein the internal surface of the holder comprises at least one wall within the holder thickness. Further, the severing position of the severing device is within the holder thickness at the opening. Additionally, at least one of the first surface and the second surface are movable against the plunger surface.

In some aspects, the apparatus further comprises a plunger movably connected to the holder, wherein the severing device is connected to the plunger. Additionally, the apparatus comprises an orientation mechanism connectable with at least one of the plunger and the holder, wherein the orientation mechanism comprises an orientation surface that maintains a predetermined relative orientation of the plunger and the holder.

In some aspects, the severing device comprises a blade having at least one edge positioned obliquely relative to a direction of the relative movement between the severing device and the holder.

In some aspects, at least one of the first receiving surface, or the second receiving surface, or the first securing surface or the second securing surface further comprises a gripping material or a gripping structure.

In some aspects, the apparatus further comprises the blister-type package comprising a medicament. The blister-type package is positionable relative to the holder such that, in the second closed position of the securing device, the opposing portions of the flange are securable between the first securing surface and the first receiving surface and between the second securing surface and the second receiving surface, respectively, with the blister-portion positioned so as to extend through the opening.

In some aspects, the apparatus further comprises a plunger movably connected to the holder, wherein the severing device is connected to the plunger. Additionally, the plunger and the holder further comprise inner walls defining an inner chamber connected to the opening, wherein the inner chamber further comprises at least one open end.

In some aspects, the apparatus further comprises a plunger movably connected to the holder, wherein the severing device is connected to the plunger. Additionally, at least one of the plunger and the holder further comprises an external-facing finger-conforming surface sized to at least partially receive human fingers.

In some aspects, the holder further comprises an outer surface facing the securing component in the second closed position, wherein the securing component is shaped to substantially conform to the outer surface in the second closed position.

In an additional aspect of an apparatus for opening a blister-type package, the apparatus comprises a holder, a severing device and a safety mechanism. The holder has a holder body comprising an internal surface defining an opening in the holder body. The holder further comprises a first receiving surface opposing a second receiving surface across the opening, wherein the opening, the first receiving surface and the second receiving surface are sized such that the opening is operable to receive a blister-portion of a blister-type package and the first receiving surface and the second receiving surface are respectively operable to receive respective portions of a flange connected to the blister-portion. Further, the severing device is connectable to the housing and relatively movable with respect to the opening into and out of a severing position. Also, the severing device in the severing position is operable to separate at least a part of the blister-portion from the blister-type package. Additionally, the safety mechanism is connectable with the severing device and comprises a blocking portion movable between a locked position and an unlocked position. In the locked position, the blocking portion is positioned to prevent the severing device from moving into the opening, and in the unlocked position, the blocking portion is positioned to allow the severing device to move into the opening.

In an additional aspect of the apparatus comprising the holder, the severing device and the safety mechanism, the apparatus further comprises a securing component connectable to the holder and movable between a first open position and a second closed position. The securing component has a first securing surface connected to a second securing surface by a recessed surface, wherein the securing component in the second closed position is operable to generate a clamping force between the first securing surface and the first receiving surface and between the second securing surface and the second receiving surface and the recessed surface is spaced away from the holder.

In yet another aspect, a method of accessing a packaged medicament comprises placing opposing flanges of a blister-type package onto corresponding receiving areas of a holder with a blister-portion of the blister-type package extending into an opening in the holder, the corresponding receiving areas opposing one another across the opening; wherein the blister-type package includes a medicament within the blister-portion. The method further comprises clamping the opposing flanges between the corresponding receiving areas of the holder and a first securing surface and a second securing surface, respectively, of a securing component movably connectable with the holder such that a recessed surface between the first securing surface and the second securing surface is spaced apart from the blister-type package. Additionally, the method comprises separating at least a part of the blister-portion from the blister-type package in between the flanges and the medicament to access the medicament.

In another aspect of the method, the separating further comprises moving a severing device and the holder relative to one another such that the severing device separates at least a part of the blister-portion from the blister-type package in between the flanges and the medicament.

In another aspect, the method further comprises blocking the severing device from moving into the opening when the blister-type package is not clamped.

In a further aspect, a method of accessing a packaged medicament comprises placing a flange of a blister-type package onto a receiving area of a holder with a blister-portion of the blister-type package extending into an opening in the holder, wherein the blister-type package includes a medicament within the blister-portion. Further, in this aspect, the method includes holding the blister-type package relative to the receiving area and the opening. Additionally, the method includes moving a severing device and the holder relative to one another such that the severing device separates at least a part of the blister-portion from the blister-type package in between the flange and the medicament. Also, the method includes blocking the severing device from moving into the opening when the blister-type package is not clamped, and accessing the medicament after the moving.

In a further aspect of this method, the holding further comprises clamping opposing flange portions between corresponding portions of the receiving area and a securing component movably connectable with the holder, the securing component comprising a recessed area corresponding to the opening such that the recessed surface is spaced apart from the blister-type package during the clamping.

DESCRIPTION

Figure 1:
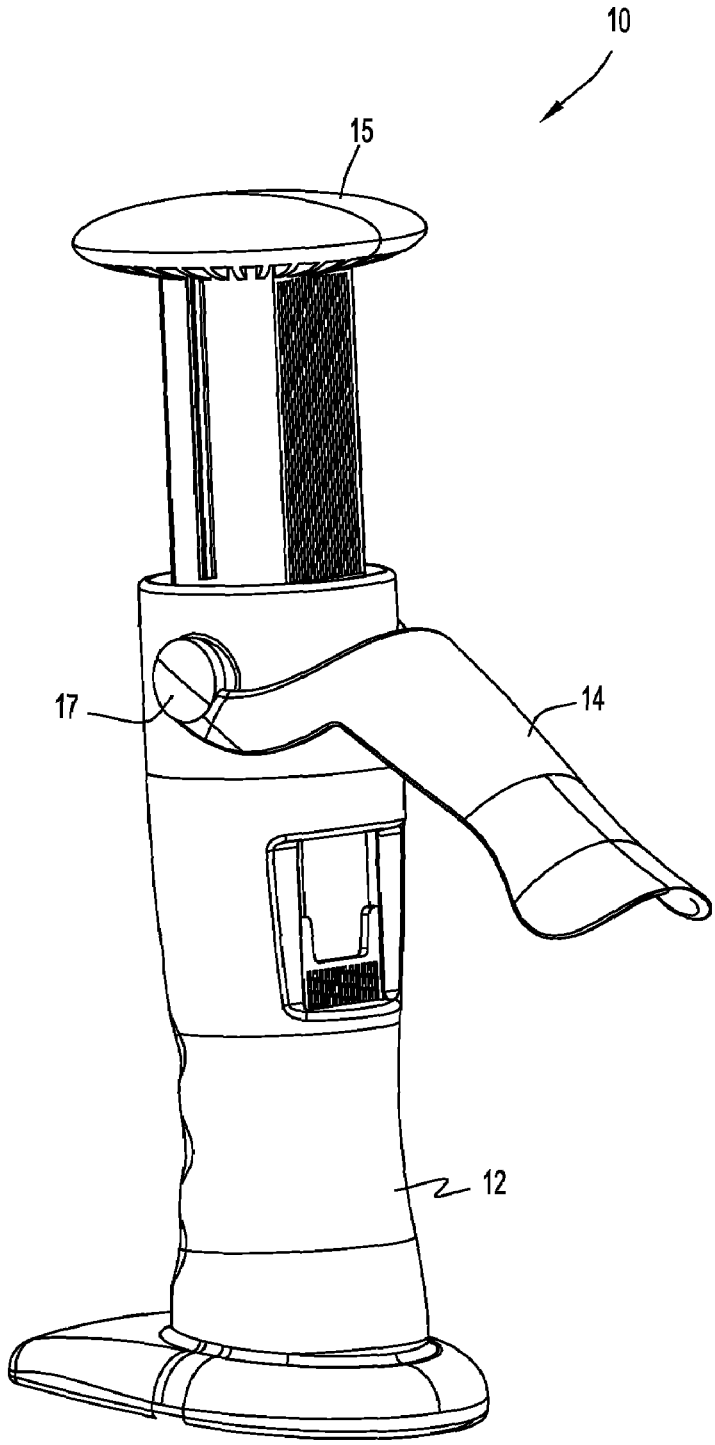
FIG. 1 is a perspective view of one aspect of the device.
Figure 2:
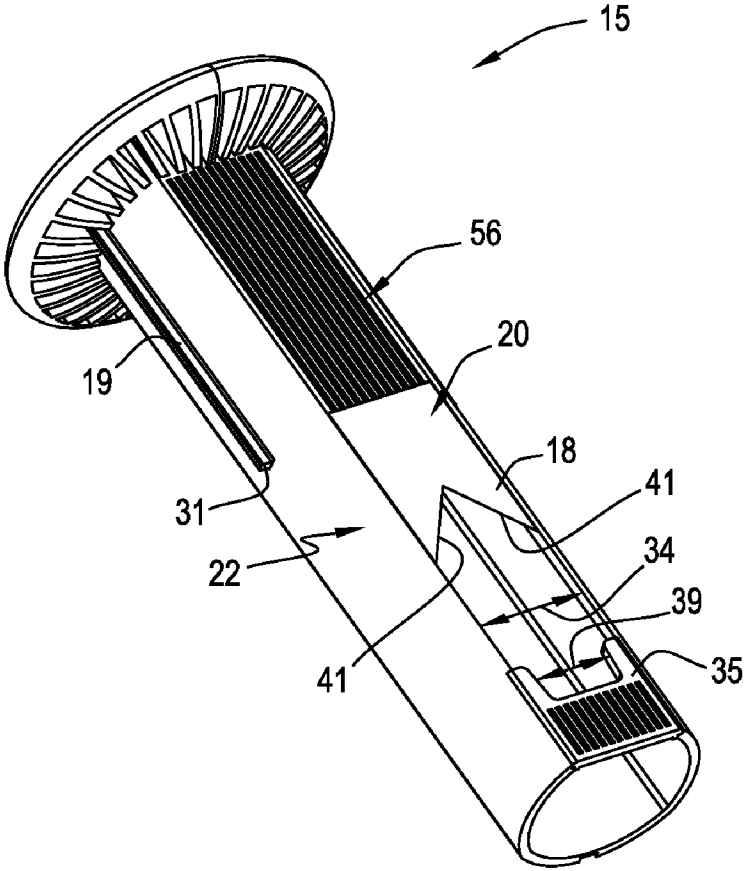
FIG. 2 is a perspective view of one aspect of a plunger component of the device of FIG. 1.
Figure 3A:
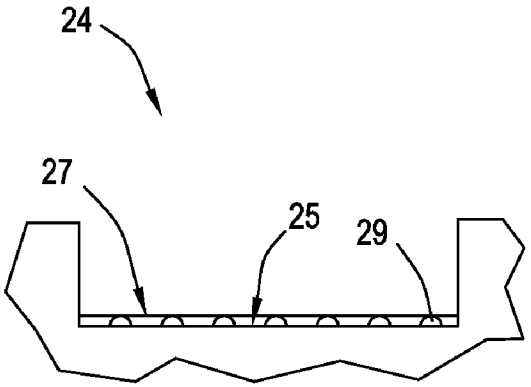
FIG. 3*a* is a partial side view of a receiving area along line 3*a*-3*a* in FIG. 3.
Figure 3:
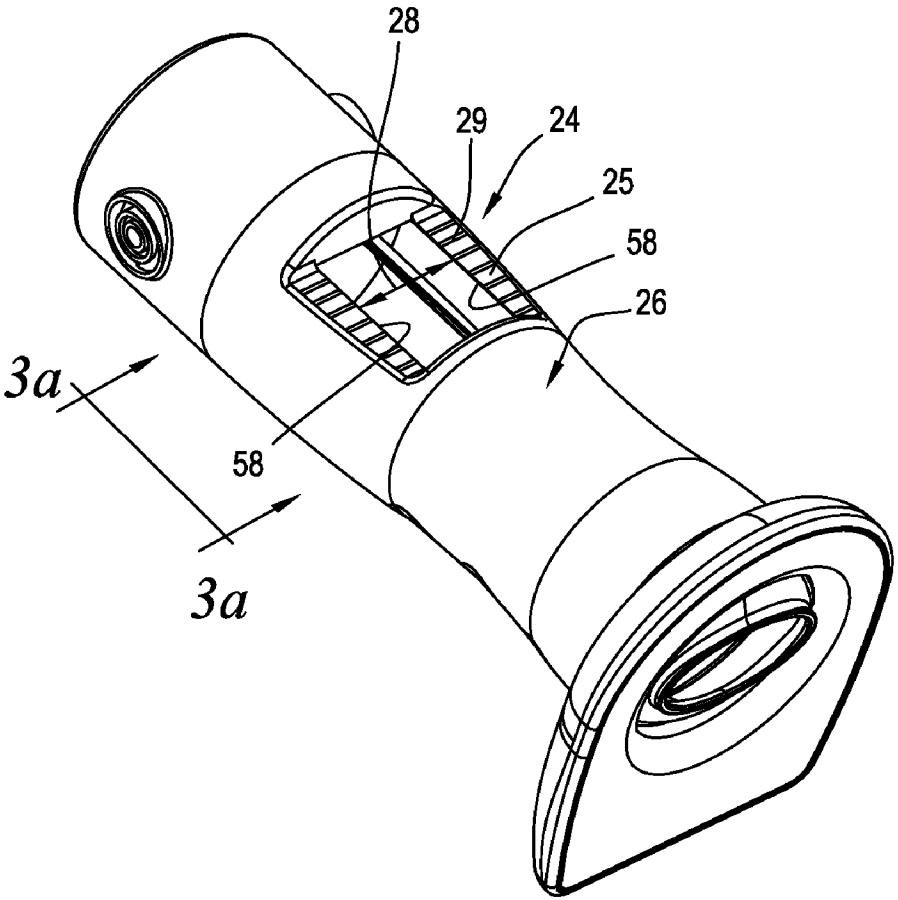
FIG. 3 is a perspective view of one aspect of a holder component of the device of FIG. 1.
Figure 4:
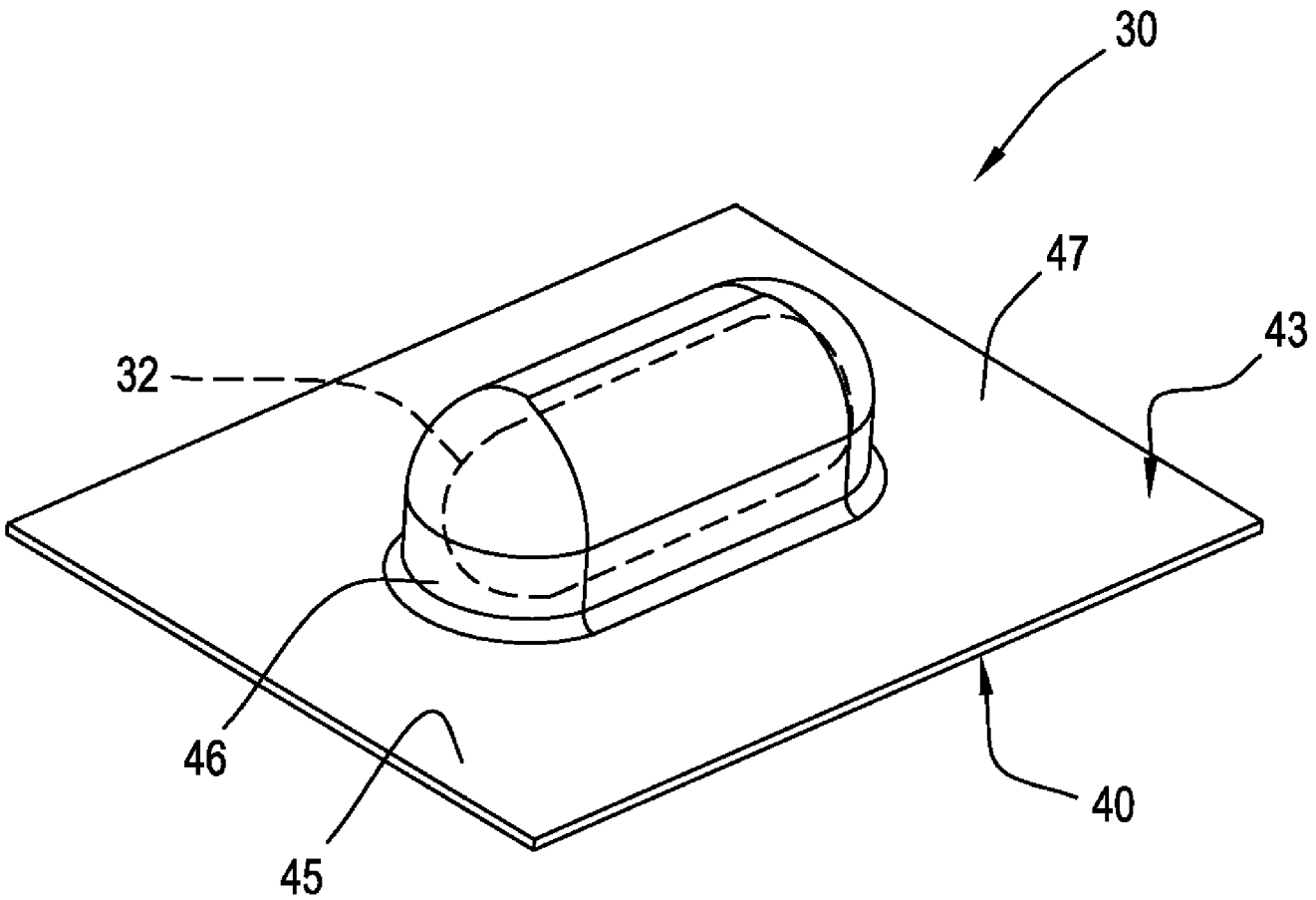
FIG. 4 is a perspective view of one aspect of a blister-type package for use in the device of FIG. 1.
Figure 5:
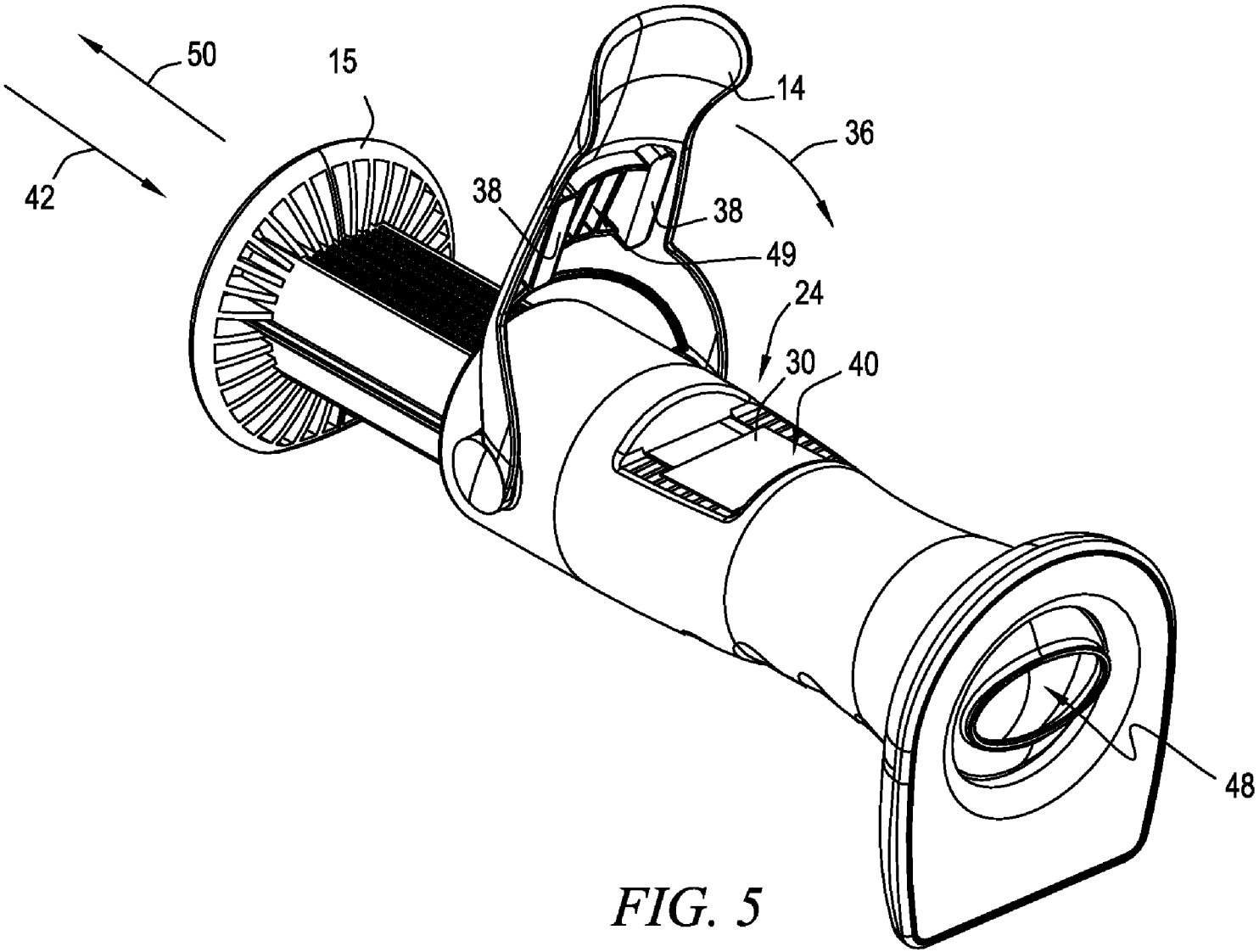
FIG. 5 is a perspective view of one aspect of a loading of the blister-type package of FIG. 4 into the device of FIG. 1, with the device in the open position.

In an aspect, an apparatus for accessing packaged medicaments comprises a holder, a plunger with an attached severing device such as a cutting blade, and a securing device/safety mechanism such as a lever. To use this apparatus, a blister pack is positioned in an opening or window of the holder so as to engage the outer surface of the holder. In some aspects, the blister portion containing the medicament is positioned with the blister protruding through a corresponding slot in the plunger. A securing device/safety mechanism is then positioned to secure the medicament for cutting and protect against accidental injury from the cutting blade. In one aspect, the securing device/safety mechanism could be a lever, in another aspect it could be a sliding finger, in yet another aspect it could be a clip, and in yet another aspect a door. In any case, the securing device/safety mechanism is moved to a closed position to press on the edges or flanges of the blister pack, which may be a least partially defined by a backing material, to hold and position the blister pack for cutting. Additionally, in some aspects, the securing device/safety mechanism in the closed position covers the opening, window or cutting area to avoid accidental injury. Further, in some aspects, the securing device/safety mechanism avoids contacting the middle of the blister pack so as to not bow the blister pack into the opening or window. In other words, a clamping force is provided to secure the flanges or edges of the blister pack and tension the blister pack across the opening or window. In some aspects, the severing device, such as a knife or cutting blade, is mounted to the plunger in a receiving groove, thereby spanning the slot in the plunger. When the plunger is depressed, the knife or cutting blade moves across the opening and slices open the blister pack between the medicament and the flanges or backing material. In some aspects, the leading edge of the knife blade may have one or more leading edges at oblique angles relative to the direction of movement to improve the efficiency of severing the medicament packaging. The leading edge or edges may include, but are not limited to, a single angled edge or a v-shaped edge, with the point of the "v" facing toward, or away from, the secured medicament. The severed blister may be partially or fully separated from the remainder of the blister pack. In one aspect, at least the medicament is accessible through the opening created in the blister. In other aspect, such as when complete separation occurs, the severed blister portion and the medicament then fall through the opening. In some aspects, the opening is connected to a chamber running through the holder, where the chamber has at least one open end. In this aspect, the severed blister portion and the medicament then fall through the chamber in the center of the holder. The medicament can then be accessed at the end of the holder. For example, if the holder is positioned on a surface with the open end of the chamber facing downward, the medicament is accessed by lifting up the entire unit. When pressure is released from holding the lever in a closed position, the remnants of the blister pack can be removed from the holder and the next blister package inserted. The plunger is then returned to its original or open position either by hand or with the aid of a return spring.

Referring to FIGS. 1 through 6, in one aspect, the device 10 comprises a holder 12, a securing device/safety mechanism such as a pivotally mounted lever 14 and a severing device such as a blade 18 connected to a plunger 15. Blade 18 is mounted to plunger 15, such as in recess 20, to suitably position blade 18 within the outer surface 22 of plunger 15 relative to a receiving area defined by holder 12 for receiving a packaged medicament. Holder 12 and plunger 15 further may include an alignment or orientation mechanism to insure blade 18 aligns with the packaged medicament held by holder 12. For example, plunger 15 further comprises outer alignment region 56 which provides rotational alignment in conjunction with inner alignment region 54 of holder 12. Holder 12 further includes a receiving area to receive packaged medicament to be opened. For example, receiving area 24 may include a ribbed region comprising surface 25 with ribs 29 that effectively create a raised surface 27. In some aspects, raised surface 27 allows for the easy removal of medicament packages from the device, or for positioning of blister-type package 30 relative to severing device 18, or both. Receiving area 24, such as ribbed region, is formed on outer surface 26 of holder 12, and includes an internal surface or wall that defines an opening 28 to receive the medicament-side, i.e. the blister portion, of blister package 30. Packaged medicament, such as blister package 30 including medicament 32, is positioned with the medicament 32 protruding through opening 28 in holder 12 and through the corresponding opening 34 in plunger 15. Optionally, smaller packaged medicaments can be aligned centrally to opening 34, with respect to a direction of relative movement of severing device 18, using an alignment component such as guide 35. More specifically, guide 35 comprises narrow opening 39 which aids in the locating of blister package 30 centrally to opening 34 when blister covering 46 is substantially smaller than opening 34. As such, in some aspects, guide 35 is movable into opening 28 to aid in securing blister package 30, and during operation of device 10 is movable out of opening 28 to allow severing device 18 to separate medicament 32 from package 30. Additionally, guide 35 effectively defines opening 28 as having a first opening size and a second opening size, wherein first opening size corresponds to a size of opening 28 and wherein second opening size corresponds to opening 39, where the second opening size is smaller than the first opening size.

Figure 11:
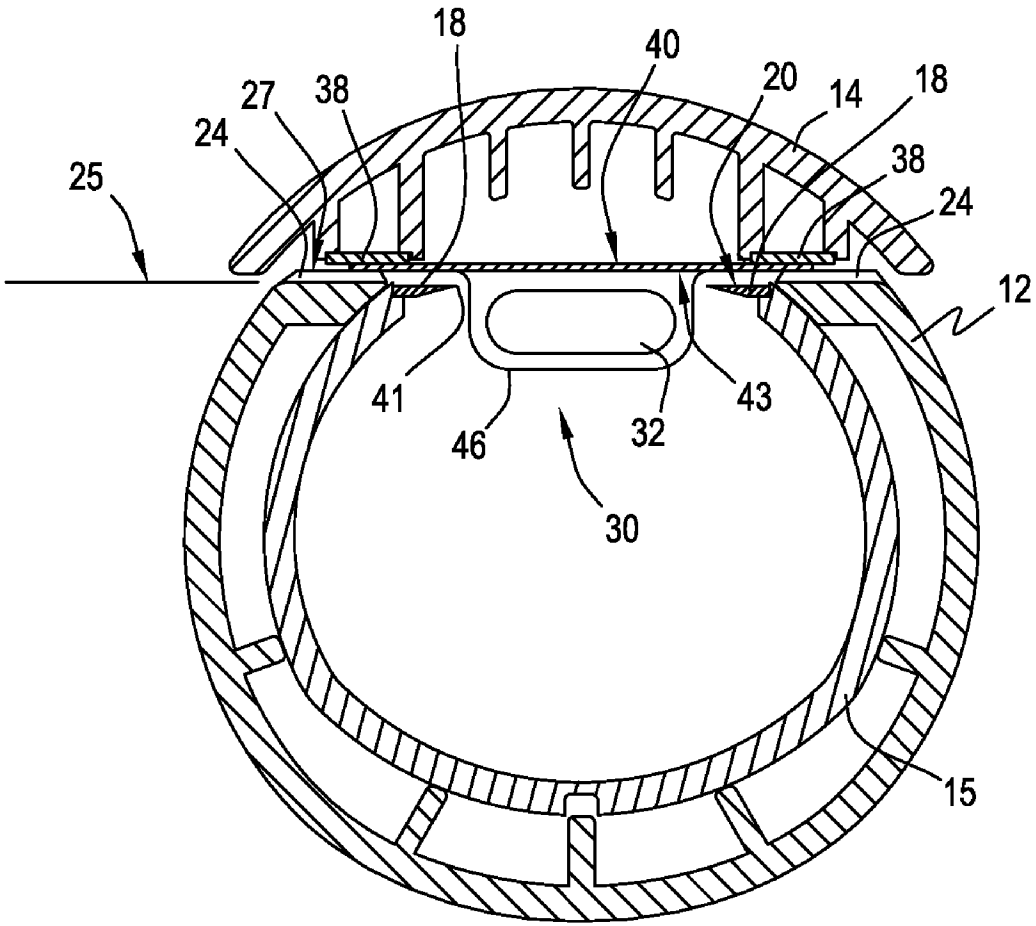
FIG. 11 is an axial cross section through the device of FIG. 1, adjacent to a secured blister-type package held in a receiving area, with the securing device/safety mechanism in a closed position.

Further, referring additionally to FIG. 11, blister package 30 is positioned such that opposing portions of the body of blister package 30, such as flanges 45 and 47, are located on corresponding portions of receiving area 24, such as on surfaces 25 or ribs 29, on opposing sides of opening 28. In one aspect, securing device/safety mechanism 14 such as lever 14 is pivotally mounted to holder 12 at hinge 17. It should be noted, however, that securing device/safety mechanism 14 may be moved linearly, curvilinearly, or in any other manner designed to enable holding of blister package 30 within device 10. In the illustrated aspect, when lever 14 is rotated in direction 36, securing surfaces or pads 38 apply pressure to the back surface 40 of blister package 30 at flanges 45 and 47, effectively clamping blister package 30 between pads 38 and respective receiving areas 24 on opposing sides of opening 28. As such, lever 14 is operable to provide a clamping force to resist movement of blister package 30 with respect to receiving area 24 and opening 28 during operation of device 10. Further, pads 38 are separated by a recessed area 49, such as one or more recessed surfaces, which correspond to an area of opening 28 and which connect pads 38. Advantageously, pads 38 clamp flanges 45 and 47 of blister package 30 to corresponding portions of receiving area 24, such as surfaces 25 or 27 while recessed area 49 avoids applying pressure to the body of blister package 30, thereby avoiding bowing the body or backing portion of blister package 30 into opening 28 and thus into the path of severing device 18. As such, recessed area 49 allows severing device 18 to cleanly separate blister portion from blister package 30 without interference from the body of blister package 30. Pads 38 may be may be molded as part of lever 14 or applied separately in the form of a high grip material, for example, comprising silicone, urethane or any elastomer. Likewise, ribs 29 in the form of a high grip material may be molded or added to create receiving region 24. It should be noted that either pads 38 or receiving region 24, or both, may be formed of any gripping material, as noted above, or any gripping structure, such as ribs, dimples, ridges, pointed extensions, a roughened surface, etc., in which the respective gripping material or structure is operable to resist movement of blister package 30 when clamped by lever 14.

Once securing device 14, such as lever, is moved into a closed position holding blister package 30 within opening 28, plunger 15 is moved along direction 42 to position severing device 18 into a severing position, where cutting edge 41 of knife or blade 18 slices into blister covering 46 of blister package 30, separating at least a portion of blister covering 46 from blister package 30, and thereby opening the package and freeing the medicament 32.

Figure 6:
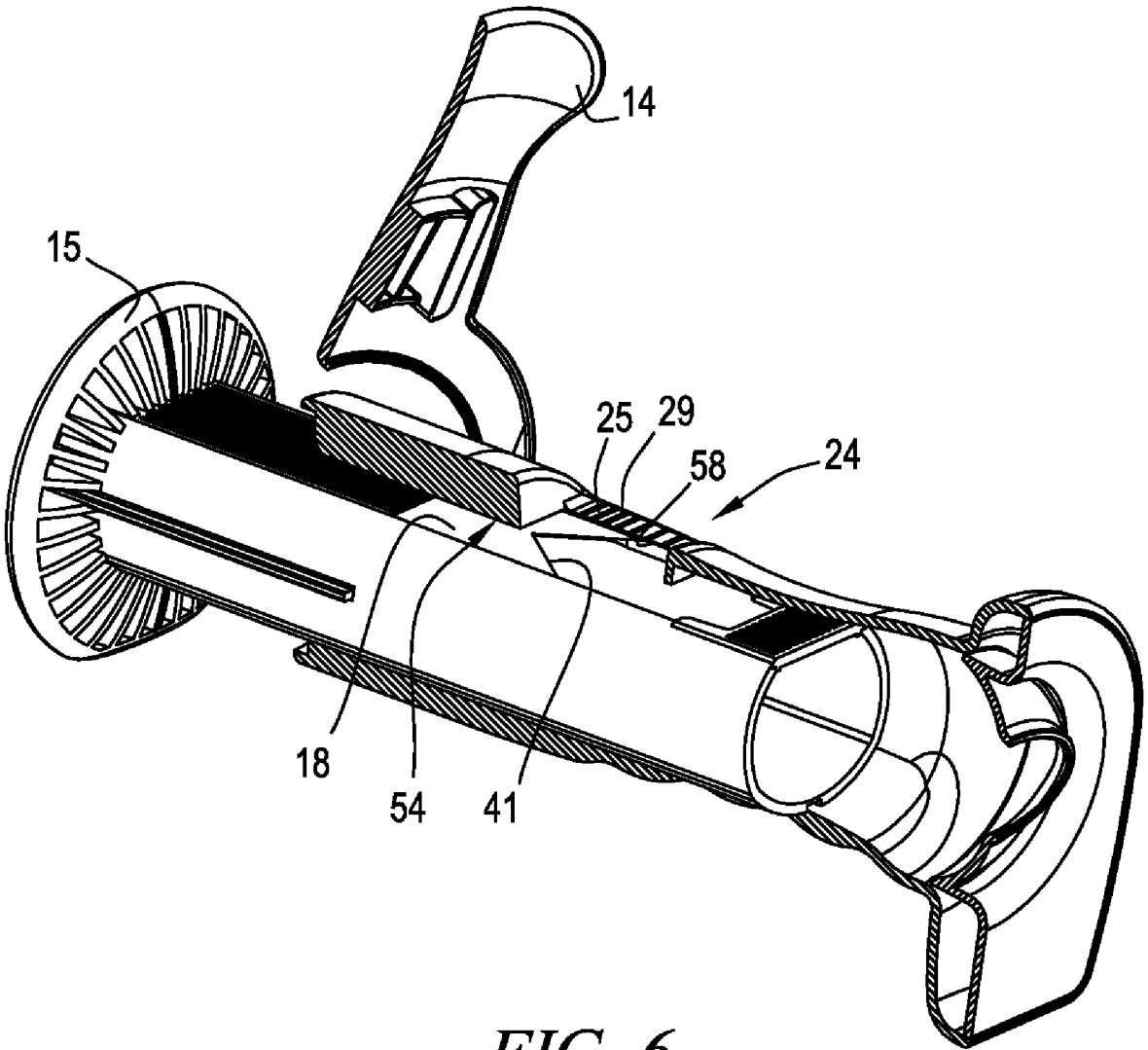
FIG. 6 is a partial section view along a longitudinal axis of the holder component of the device of FIG. 1 in an open position.

Referring now specifically to FIG. 6, in one aspect, the construction of holder 12, and more specifically surface 25, yields edge 58. During operation, knife or blade 18 slides adjacent to edge 58, thus positioning knife 18 nearly co-planer to surface 25. Receiving region 24, and more specifically ribs 29 in some aspects, position front surface 43 of medicament 30 at raised surface 27, just above blade 18. The difference in height of blade 18 and surface 27 allow for removal of blister covering 46 by positioning cutting edge 41 in the gap between surface 43 and medicament 32, where damage to medicament 32 can be avoided.

Figure 10:
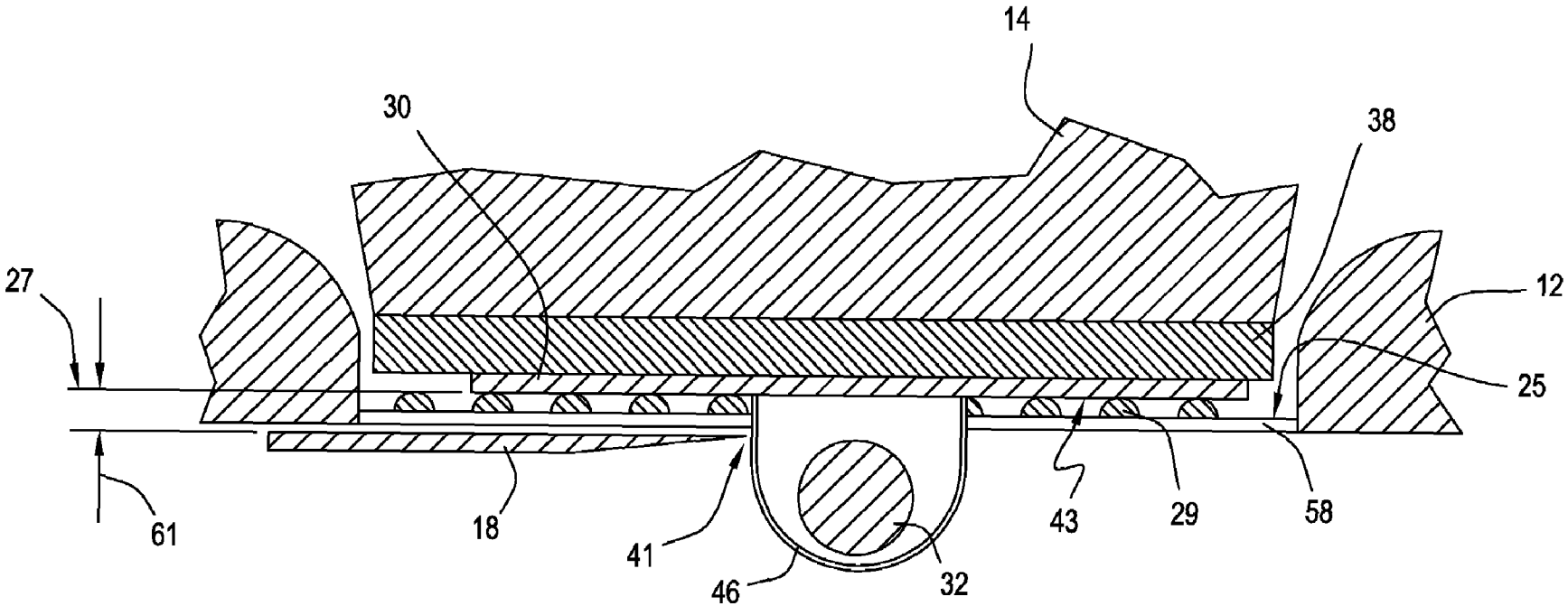
FIG. 10 is a partial section view along a longitudinal axis of the device of FIG. 1 during actuation of the plunger component, with the securing device providing a clamping force to hold the blister-type package within an opening and on a receiving area on the holder component, with a severing device in a severing position with respect to the blister-type package.
Figure 10A:
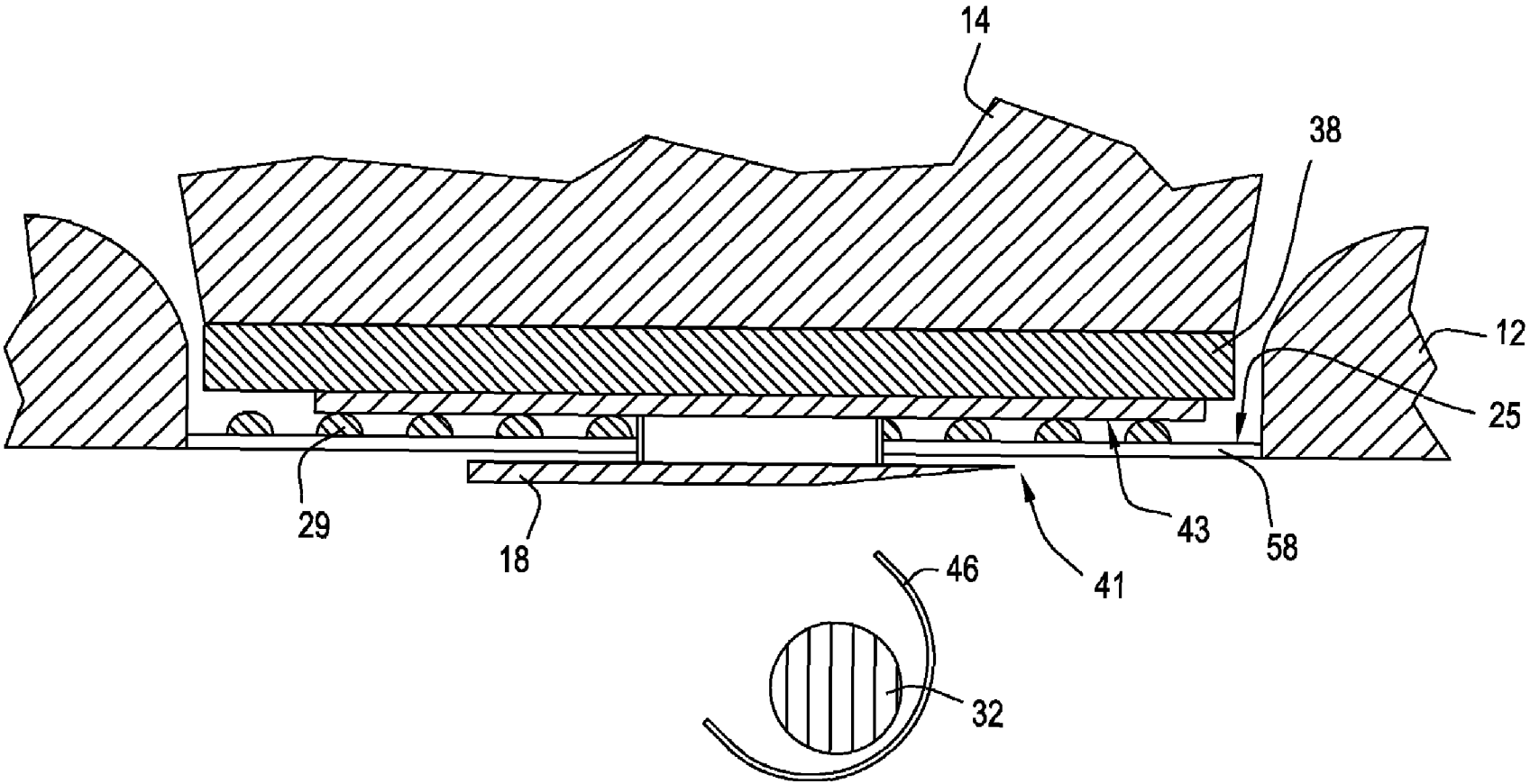
FIG. 10*a* is a partial section view, similar to FIG. 10, but with the severing device moving across the blister-type package and separating a blister-portion and a medicament from the blister-type package.

More specifically, referring now to FIGS. 10 and 10*a,* in one aspect, the presence of edge 58 and ribs 29 position knife 18 close to surface 43 of blister package 30, resulting in a cutting plane slightly offset by a distance 61 to surface 43. Offset 61 allows for blade 18 to open blister package 30 without catching on the package backing, as well as minimizing the risk of damaging medicament 32 during the cutting operation.

Once knife 18 has passed completely through blister covering 46 of package 30, medicament 32 then falls free through opening 48. When plunger 15 is moved in direction 50 and lever 14 is rotated in direction 52, in other words moved back toward the open position, the remnants of package 30 can then be removed from the receiving area 24.

Figure 7:
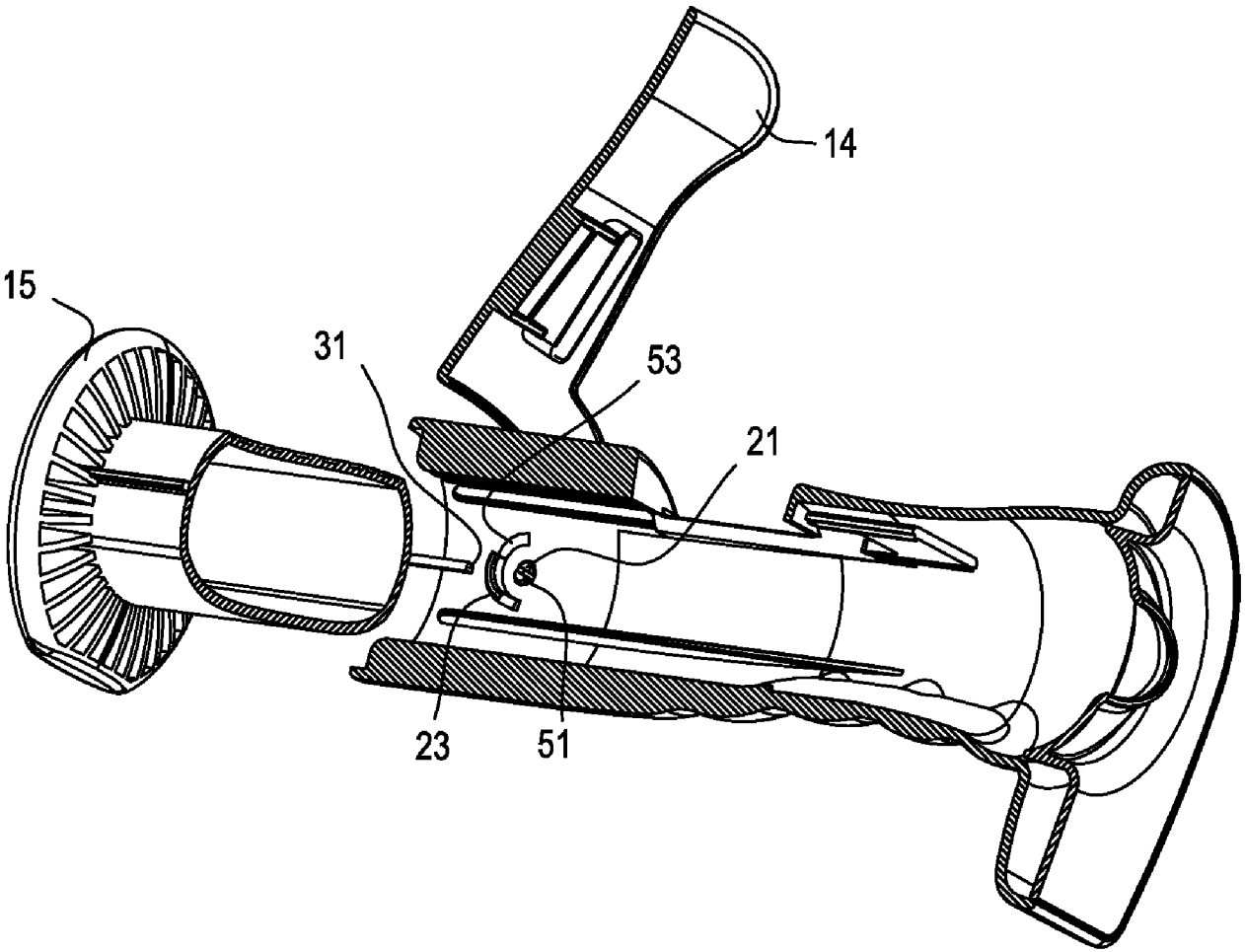
FIG. 7 is a partial section view of the plunger component and the holder component, including a blocking portion in a locked position of a safety mechanism of one aspect of the device of FIG. 1.
Figure 8:
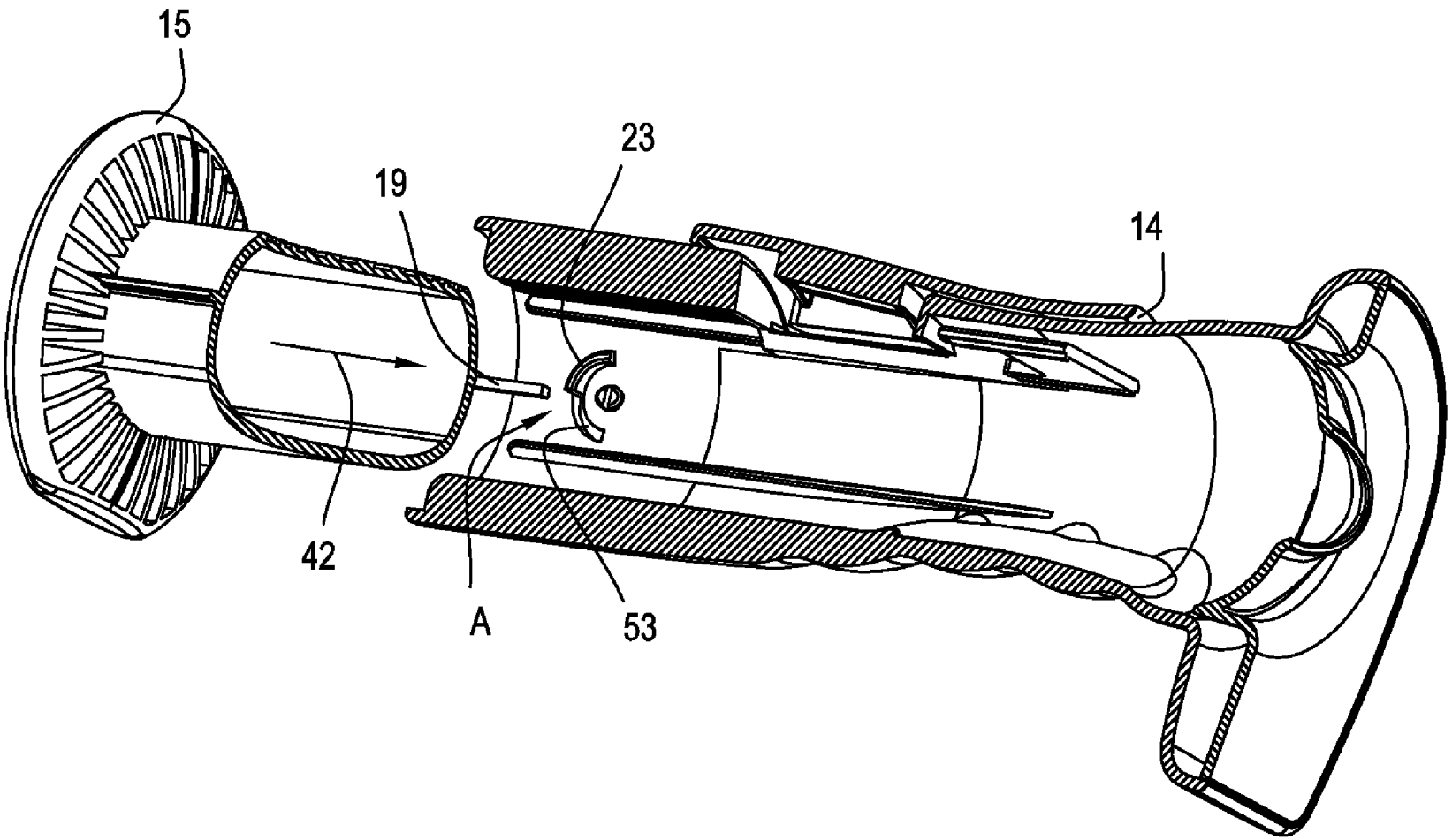
FIG. 8 is a partial section view of the plunger component and the holder component, prior to actuation of the plunger, including a blocking portion in an unlocked position of a safety mechanism of one aspect of the device of FIG. 1.
Figure 9:
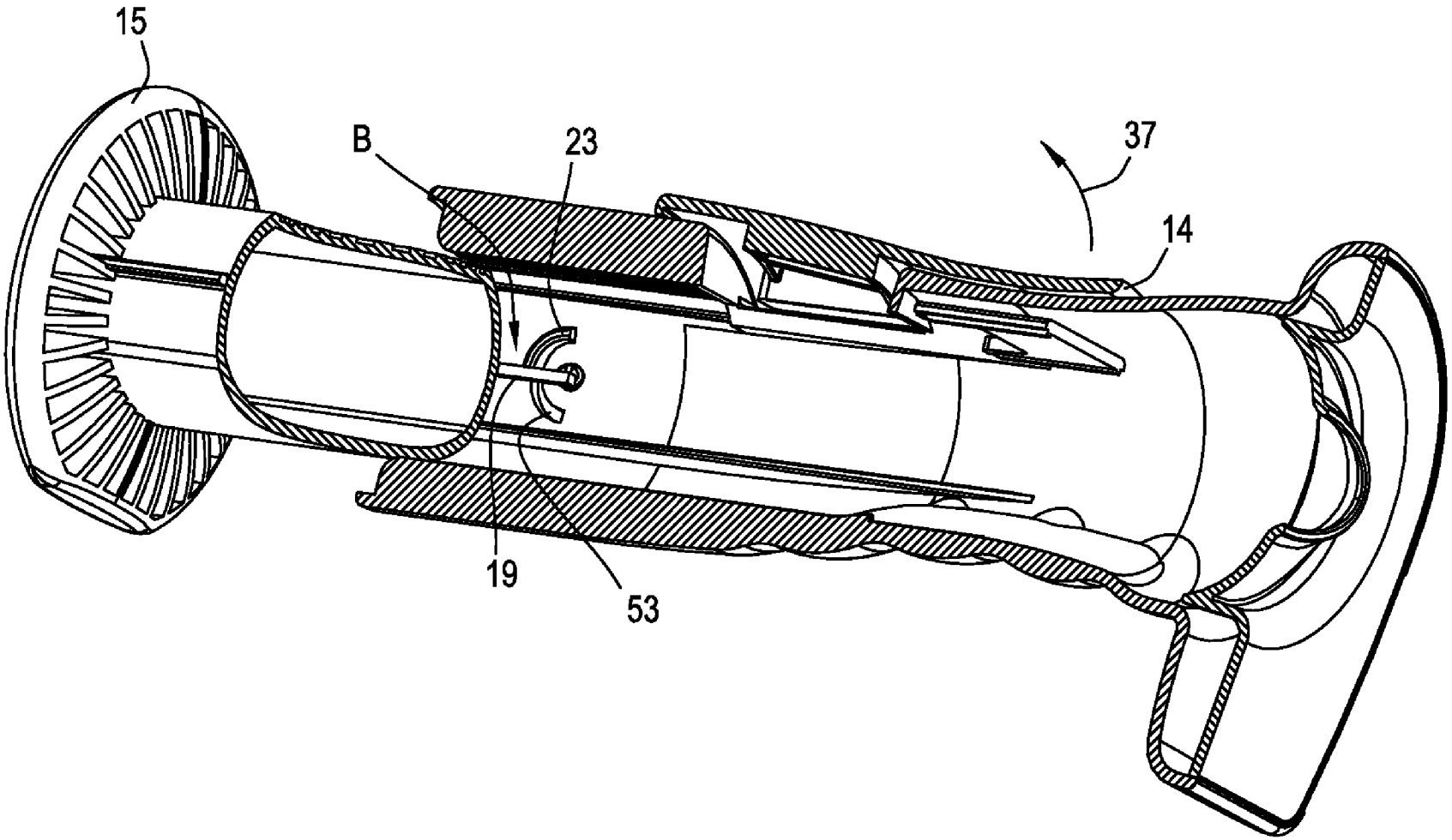
FIG. 9 is a partial section view of the plunger component and the holder component, during actuation of the plunger, including a blocking portion in an unlocked position of a safety mechanism of one aspect of the device of FIG. 1.

Referring now to FIGS. 1 and 7-9, an aspect of a lockable safety mechanism for an apparatus for accessing packaged medicaments is presented. Recall that securing device/safety mechanism 14, such as lever in the illustrated aspect, is movably mounted to body 12, for example, via hinge 17. To limit access to blade 18 during cutting operations, a safety mechanism aspect of device 10, the hinge 17 comprises pin 21 and flange 23 connected to lever 14, and hole 51 and slot 53 as part of holder 12. Further, plunger 15 includes rails 19 which selectively engage flange 23, which thus is operable to act as a blocking portion. With plunger 15 in the open or safety locked position as shown in FIG. 7, rail end 31 clears the travel region of flange 23 within slot 53, resulting in unencumbered rotational travel of lever 14 via slot 53. In this position, however, flange 23 acts as a blocking portion, which resists movement of plunger 15 toward opening 28, thereby preventing severing device 18 from entering opening 28 when the opening 28 is not covered by securing device/safety mechanism 14. When lever 14 is closed, as shown in FIG. 8, flange 23 clears rail 19 at region A, and thus the blocking portion is moved out of the path of plunger 15, allowing plunger 15 to move downwardly and severing device 18 to move into opening 28. Additionally, with plunger 15 in the down or closed position as shown in FIG. 9, if lever 14 is moved slightly from the closed position in direction 37, flange 23 rotates into path of rail 19 at region B, effectively locking lever 14 in the closed position. As such, a blocking portion of movable between a locked position and an unlocked position corresponding to the first open position and the second closed position, respectively, of the securing device/safety mechanism 14, wherein in the locked position the blocking portion is positioned to prevent the severing device from moving into the opening, and wherein in the unlocked position the blocking portion is positioned to allow the severing device to move into the opening. Thus, in one aspect, the lockable safety mechanism is arranged to effectively eliminate unintended access to knife 18 by only allowing lever 14 to open when knife 18 is retracted and not allowing lever 14 to open when knife 18 is extended into opening 28.

Thus, in operation, one aspect of a method of accessing a packaged medicament comprises placing opposing flanges of a blister-type package onto corresponding receiving areas of a holder with a blister-portion of the blister-type package extending into an opening in the holder, the corresponding receiving areas opposing one another across the opening; wherein the blister-type package includes a medicament within the blister-portion. The method further comprises clamping the opposing flanges between the corresponding receiving areas of the holder and a first securing surface and a second securing surface, respectively, of a securing component movably connectable with the holder such that a recessed surface between the first securing surface and the second securing surface is spaced apart from the blister-type package. Additionally, the method comprises separating at least a part of the blister-portion from the blister-type package in between the flanges and the medicament to access the medicament.

In another aspect of the method, the separating further comprises moving a severing device and the holder relative to one another such that the severing device separates at least a part of the blister-portion from the blister-type package in between the flanges and the medicament.

In another aspect, the method further comprises blocking the severing device from moving into the opening when the blister-type package is not clamped.

In a further aspect of operation, a method of accessing a packaged medicament comprises placing a flange of a blister-type package onto a receiving area of a holder with a blister-portion of the blister-type package extending into an opening in the holder, wherein the blister-type package includes a medicament within the blister-portion. Further, in this aspect, the method includes holding the blister-type package relative to the receiving area and the opening. Additionally, the method includes moving a severing device and the holder relative to one another such that the severing device separates at least a part of the blister-portion from the blister-type package in between the flange and the medicament. Also, the method includes blocking the severing device from moving into the opening when the blister-type package is not clamped, and accessing the medicament after the moving.

In a further aspect of this method, the holding further comprises clamping opposing flange portions between corresponding portions of the receiving area and a securing component movably connectable with the holder, the securing component comprising a recessed area corresponding to the opening such that the recessed surface is spaced apart from the blister-type package during the clamping.

While the foregoing disclosure discusses illustrative aspects and/or embodiments, it should be noted that various changes and modifications could be made herein without departing from the scope of the described aspects and/or embodiments as defined by the appended claims. For example, while interacting structures of the device may be described as being located on one component or another component, it should be understood that the structures may be switched between components to achieve the same function. Accordingly, the described aspects are intended to embrace all such alterations, modifications and variations that fall within the scope of the appended claims. Furthermore, although elements of the described aspects and/or embodiments may be described or claimed in the singular, the plural is contemplated unless limitation to the singular is explicitly stated. Also, to the extent that the term "includes" is used in either the description or the claims, such term is intended to be inclusive in a manner similar to the term "comprising" as "comprising" is interpreted when employed as a transitional word in a claim. Additionally, all or a portion of any aspect and/or embodiment may be utilized with all or a portion of any other aspect and/or embodiment, unless stated otherwise.

What is claimed is:

1. An apparatus for opening a blister-type package, comprising:

a holder having a holder body comprising an internal surface defining an opening in the holder body, the holder further comprising a first receiving surface opposing a second receiving surface across the opening, wherein the opening is sized to receive a blister-portion of a blister-type package having a flange connected to the blister-portion, wherein the receiving surface is configured to receive corresponding opposing portions of the flange; a plunger movably connected to the holder, wherein the plunger comprises a plunger surface; a severing device connected to the plunger and relatively movable with respect to the opening into and out of a severing position, wherein the severing device in the severing position is operable to separate at least a part of the blister-portion from the blister-type package; and a securing component connectable to the holder and movable between a first open position and a second closed position, the securing component having a first securing surface connected to a second securing surface by a recessed surface, wherein the securing component in the second closed position is operable to generate a clamping force between the first securing surface and the first receiving surface and between the second securing surface and the second receiving surface and the recessed surface is spaced away from the holder; and wherein the holder body comprises a first surface and a second surface defining a holder thickness, wherein the internal surface of the holder comprises at least one wall within the holder thickness, wherein the severing position of the severing device is within the holder thickness at the opening, and wherein at least one of the first surface and the second surface are movable against the plunger surface.

2. The apparatus of claim 1, wherein a size of the recessed surface substantially corresponds to a size of the opening.

3. The apparatus of claim 1, wherein the opening comprises a first length and a first width both substantially in a first plane, and wherein the recessed surface comprises a second length and a second width both substantially in a second plane, wherein the second length substantially corresponds to the first length and the second width substantially corresponds to the first width.

4. The apparatus of claim 1, further comprising a safety mechanism connectable with the securing component, wherein the safety mechanism comprises a blocking portion movable between a locked position and an unlocked position corresponding to the first open position and the second closed position, respectively, wherein in the locked position the blocking portion is positioned to prevent the severing device from moving into the opening, and wherein in the unlocked position the blocking portion is positioned to allow the severing device to move into the opening.

5. The apparatus of claim 1, further comprising a blister alignment component positionable relative to the opening to define a first opening size and a second opening size, wherein the second opening size is less than the first opening size.

6. The apparatus of claim 5, wherein a first portion of the internal surface of the holder defines at least a portion of the first opening size, and wherein the blister alignment component comprises opposing alignment surfaces that define at least a portion of the second opening size, wherein the first opening size is dimensioned to receive a first size blister-portion, and wherein the second opening size is dimensioned to receive a second size blister-portion smaller than the first size blister-portion.

7. The apparatus of claim 6, wherein in a direction of the relative movement of the severing device and the holder, the opposing alignment surfaces are equally spaced from a centerline of the opening, wherein the centerline is substantially parallel to the direction of relative movement.

8. The apparatus of claim 1, further comprising: an orientation mechanism connectable with at least one of the plunger and the holder, wherein the orientation mechanism comprises an orientation surface that maintains a predetermined relative orientation of the plunger and the holder.

9. The apparatus of claim 1, wherein the severing device comprises a blade having at least one edge positioned obliquely relative to a direction of the relative movement between the severing device and the holder.

10. The apparatus of claim 1, wherein at least one of the first receiving surface, or the second receiving surface, or the first securing surface or the second securing surface further comprises a gripping material or a gripping structure.

11. The apparatus of claim 1, further comprising the blister-type package comprising a medicament, wherein the blister-type package is positionable relative to the holder such that, in the second closed position of the securing device, the opposing portions of the flange are securable between the first securing surface and the first receiving surface and between the second securing surface and the second receiving surface, respectively, with the blister-portion positioned so as to extend through the opening.

12. The apparatus of claim 1, wherein the plunger and the holder further comprise inner walls defining an inner chamber connected to the opening, wherein the inner chamber further comprises at least one open end.

13. The apparatus of claim 1, wherein at least one of the plunger and the holder further comprises an external-facing finger-conforming surface sized to at least partially receive human fingers.

14. The apparatus of claim 1, wherein the holder further comprises an outer surface facing the securing component in the second closed position, wherein the securing component is shaped to substantially conform to the outer surface in the second closed position.

* * * * *